US011103071B2

(12) United States Patent
Yang

(10) Patent No.: US 11,103,071 B2
(45) Date of Patent: Aug. 31, 2021

(54) COLLAPSIBLE CHAIR

(71) Applicant: ZHEJIANG HENGFENG TOP LEISURE CO., LTD, Zhejiang (CN)

(72) Inventor: Baoqing Yang, Zhejiang (CN)

(73) Assignee: ZHEJIANG HENGFENG TOP LEISURE CO., LTD, Zhejiang (CN)

( * ) Notice: Subject to any disclaimer, the term of this patent is extended or adjusted under 35 U.S.C. 154(b) by 80 days.

(21) Appl. No.: 16/438,400

(22) Filed: Jun. 11, 2019

(65) Prior Publication Data

US 2019/0374036 A1 Dec. 12, 2019

(30) Foreign Application Priority Data

Jun. 11, 2018 (CN) ..... 201820897458.5
Mar. 22, 2019 (CN) ..... 201920370714.X

(51) Int. Cl.
*A47C 5/10* (2006.01)
*A47C 3/12* (2006.01)
*A47C 4/48* (2006.01)

(52) U.S. Cl.
CPC ..... *A47C 5/10* (2013.01); *A47C 3/12* (2013.01); *A47C 4/48* (2013.01)

(58) Field of Classification Search
None
See application file for complete search history.

(56) References Cited

U.S. PATENT DOCUMENTS 6,332,646 B1 * 12/2001 Tseng ..... A47C 4/42 297/16.1
6,899,384 B1 * 5/2005 Tseng ..... A47C 4/24 297/16.1
7,011,372 B1 * 3/2006 Hsieh ..... F16B 7/0406 297/440.24
D555,378 S * 11/2007 Tsai ..... D6/368
D713,191 S * 9/2014 Akkad ..... D6/716
D761,605 S * 7/2016 Akkad ..... D6/716
2006/0158010 A1 * 7/2006 Hsieh ..... A47C 4/48 297/16.1
2011/0043003 A1 * 2/2011 Akkad ..... A47C 4/24 297/16.1
2014/0042779 A1 * 2/2014 Akkad ..... A47C 4/48 297/16.1

(Continued)

FOREIGN PATENT DOCUMENTS

EP 1127516 A1 * 8/2001 ..... A47C 4/24
GB 934833 A * 8/1963 ..... A47C 4/48

*Primary Examiner* — David E Allred
(74) *Attorney, Agent, or Firm* — Yue (Robert) Xu; Apex Attorneys at Law, LLP

(57) ABSTRACT

A collapsible chair is provided, including a seat frame tube, and a support bracket having a mirror structure, wherein the support bracket including a first front leg tube, a second front leg tube, a rear leg tube, and a connecting plate, a top end of the first front leg tube is hinged with an upper portion of the seat frame tube, a bottom end of the first front leg tube is hinged with the top end of the second front leg tube, a top end of the rear leg tube and one end of the connecting plate are hinged with a lower portion of the seat frame tube, and a hinge portion of the first front leg tube and the second front leg tube is slidable along the connecting plate, and the second front leg tube is hinged with the rear leg tube at a certain position.

12 Claims, 8 Drawing Sheets

(56) References Cited

U.S. PATENT DOCUMENTS

| | | | | |
|---|---|---|---|---|
| 2014/0097649 | A1* | 4/2014 | Cardona | A47C 4/00 297/129 |
| 2017/0105527 | A1* | 4/2017 | Choi | A47C 4/24 |
| 2017/0340118 | A1* | 11/2017 | Jin | A47C 4/48 |

* cited by examiner

COLLAPSIBLE CHAIR

CROSS REFERENCE TO RELATED APPLICATIONS

This application claims the priorities to Chinese patent application No. 201820897458.5, titled "MOON CHAIR", filed with the China National Intellectual Property Administration on Jun. 11, 2018 and Chinese patent application No. 201920370714.X, titled "MOON CHAIR", filed with the China National Intellectual Property Administration on Mar. 22, 2019, the entire disclosures of which are hereby incorporated by reference.

FIELD

The present application relates to the technical field of chairs, specifically to a collapsible chair.

BACKGROUND

A collapsible chair is a commonly used item in daily life and is popular because it takes up less space when folded, is easy to store, and is easy to carry. The current collapsible chair still has a large volume after being folded, and has a complicated structure and is easily damaged.

Therefore, how to provide a collapsible chair to further reduce the volume after being folded and have a simple structure is a technical problem to be solved by those skilled in the art.

SUMMARY

In view of this, a collapsible chair is provided according to the present application to further reduce the volume after being folded.

In order to achieve the above object, the present application provides the following technical solutions.

A collapsible chair includes a seat frame tube, and a support bracket having a mirror structure. The support bracket includes a first front leg tube, a second front leg tube, a rear leg tube, and a connecting plate, a top end of the first front leg tube is hinged with an upper portion of the seat frame tube, a bottom end of the first front leg tube is hinged with a top end of the second front leg tube, the top end of the rear leg tube and one end of the connecting plate are hinged with a lower portion of the seat frame tube, and a hinge portion of the first front leg tube and the second front leg tube is slidable along the connecting plate, and the second front leg tube is hinged with the rear leg tube at a position having a certain distance from the top end of the second front leg tube.

Preferably, the top end of the rear leg tube and the connecting plate are hinged with the lower portion of the seat frame tube at a same position.

Preferably, the first front leg tube and the second front leg tube are located inside the connecting plate.

Preferably, the first front leg tube is located inside the connecting plate and the second front leg tube is located outside the connecting plate, or, the first front leg tube is located outside the connecting plate and the second front leg tube is located inside the connecting plate.

Preferably, the second front leg tube is closer to a mirror surface of the mirror structure than the rear leg tube.

Preferably, a left side and a right side of the seat frame tube are symmetrically disposed with a connecting rod, respectively, and the top end of the first front leg tube is hinged with the upper portion of the connecting rod, the top end of the rear leg tube and one end of the connecting plate are hinged with the lower portion of the connecting rod.

Preferably, the top end of the rear leg tube and the connecting plate are hinged with the connecting rod at a same position.

Preferably, the connecting rod is provided with a bending portion.

Preferably, the connecting plate is provided with a sliding sleeve, the hinge between the bottom end of the first front leg tube and the top end of the second front leg tube is provided on the sliding sleeve.

Preferably, the connecting plate is provided with a slide groove, the hinge between the bottom end of the first front leg tube and the top end of the second front leg tube is slidable in the slide groove.

Preferably, the slide groove is a through hole, the first front leg tube and the second front leg tube are hinged by a pin shaft, and the pin shaft is arranged within the slide groove.

Preferably, the lower portion of one end of the slide groove is provided with a first limiting groove and the lower portion of another end is provided with a second limiting groove.

Preferably, an end portion of the pin shaft is provided with a limiting plate, and the limiting plate is stuck on a side wall of the slide groove.

Since the first front leg tube and the second front leg tube are connected at the hinge position, the connection between the two has a rotatable point, the rotatable point may slide in the slide groove of the connecting plate, when the rotatable point slides to the last end of the connecting plate, the collapsible chair is opened, when the second front leg tube is rotated backward, the rotatable point may slide in the slide groove of the connecting plate, and the collapsible chair is folded until the first front leg tube, the second front leg tube, the rear leg tube, and the connecting plate are completely folded into one plane, so that the folding of the collapsible chair is achieved. A long front leg tube of the collapsible chair is cut into the first front leg tube and the second front leg tube, which are folded inward to achieve folding, each front leg tube is completely under a seat level after folding, and the length is shorter, and an overlap is completed in one plane, the folding thickness is small and the volume after folding is reduced.

The collapsible chair according to the present application includes a seat frame tube and a support bracket having a mirror structure, a left side and a right side of the seat frame tube are symmetrically disposed with a connecting rod, respectively, and the support bracket includes a first front leg tube, a second front leg tube, a rear leg tube and a connecting plate, the connecting plate is provided with a slid groove, the top end of the first front leg tube is hinged with the upper portion of the connecting rod, the bottom end thereof is hinged with the top end of the second front leg tube, and the hinge between the two is slidable in the slide groove. The top end of the rear leg tube and the end portion away from the slide groove on the connecting plate are hinged with the lower portion of the connecting rod, and the rod body of the second front leg tube is hinged with the rod body of the rear leg tube.

BRIEF DESCRIPTION OF DRAWINGS

In order to more clearly illustrate the embodiments of the present application or the technical solutions in the conventional art, the drawings used in the embodiments or the conventional art description will be briefly described below.

Obviously, the drawings in the following description are some embodiments of the present application, and those skilled in the art can obtain other drawings according to the drawings without any creative work.

Figure 1:
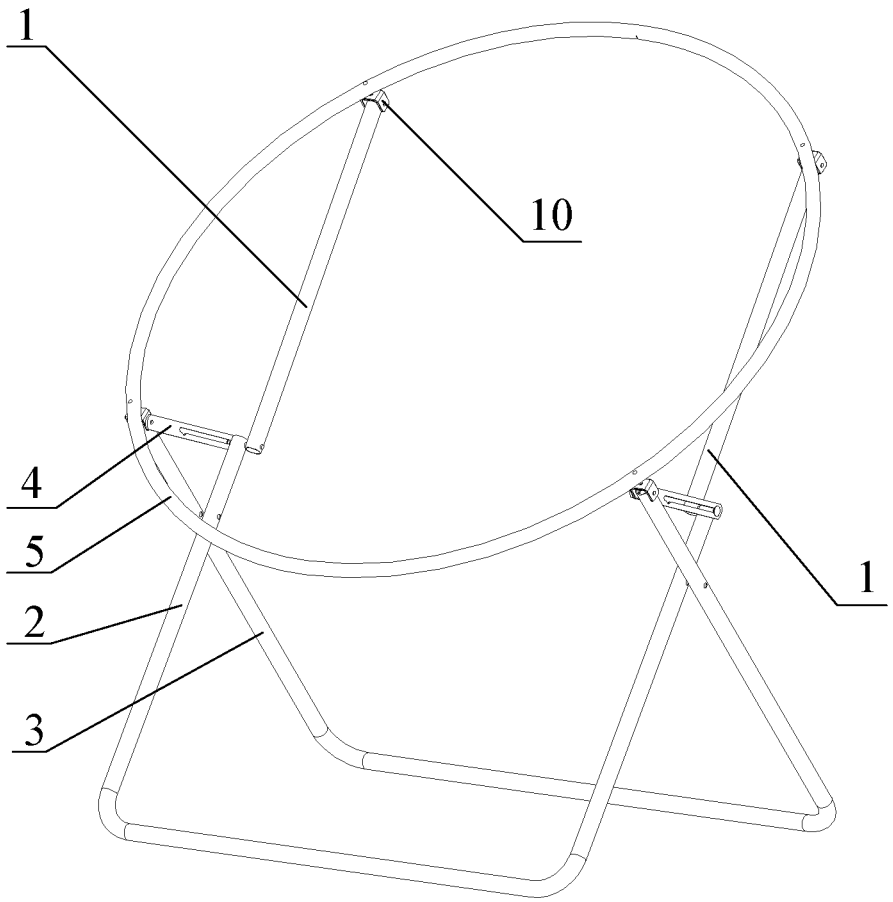
FIG. 1 is a schematic view showing the structure of a collapsible chair in an opening state according to a first embodiment of the present application.
Figure 2:
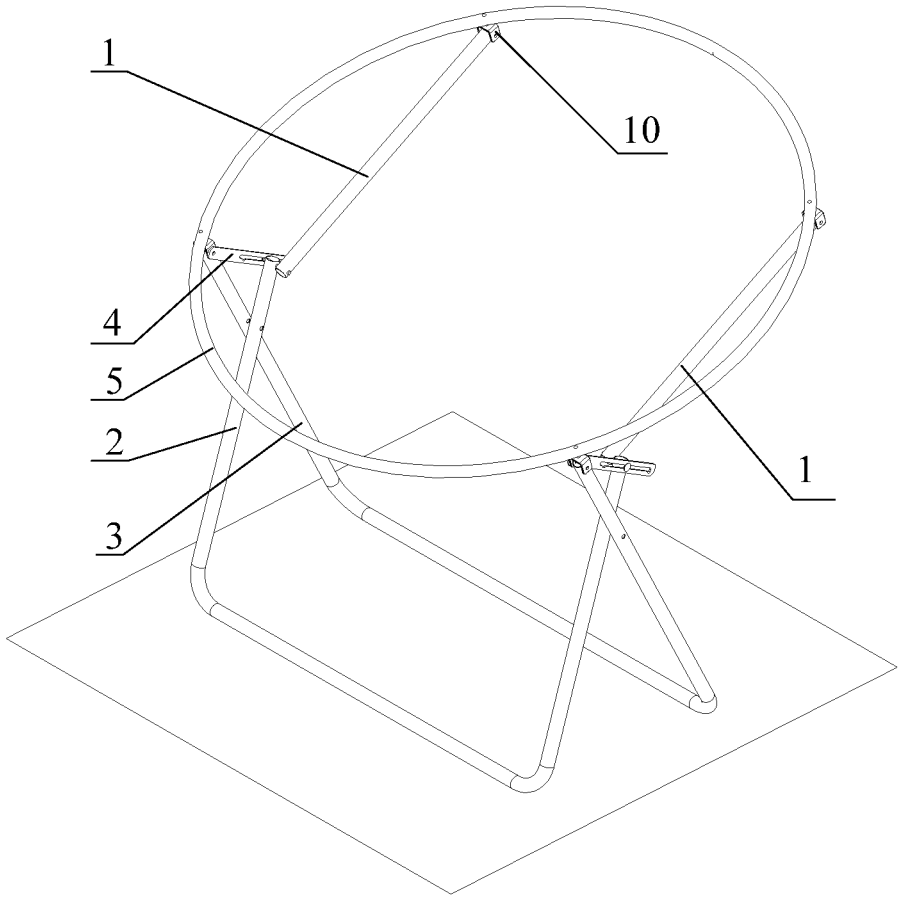
FIG. 2 is a schematic view showing the structure of the collapsible chair in a folding state according to the first embodiment of the present application.
Figure 3:
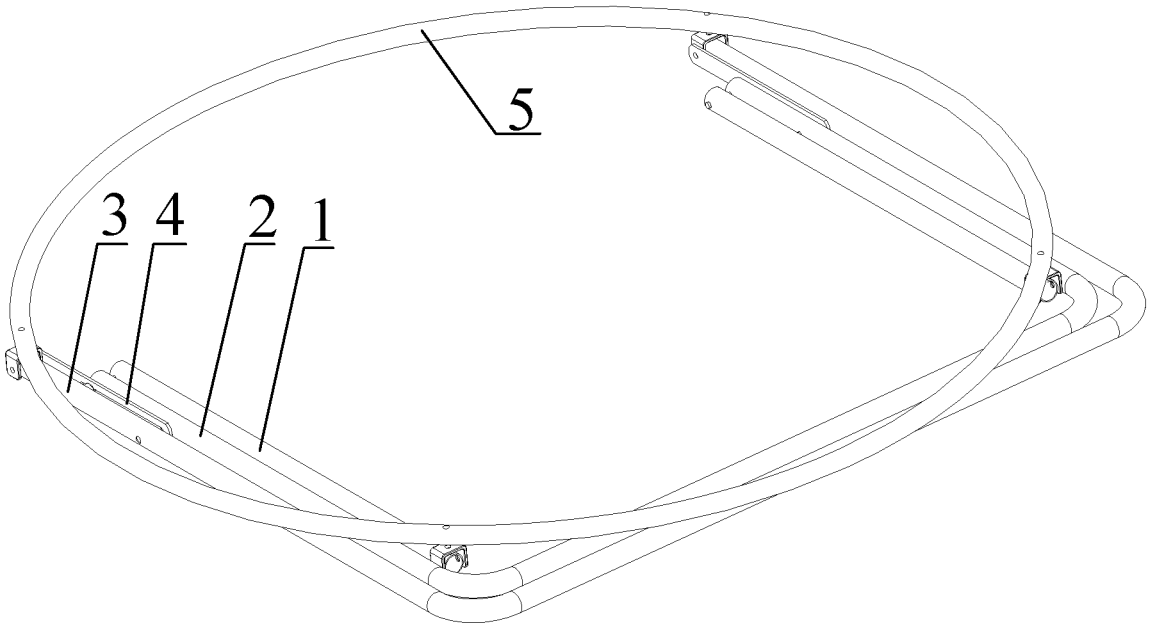
FIG. 3 is a schematic view showing the structure of the collapsible chair after being folded according to the first embodiment of the present application.
Figure 4:
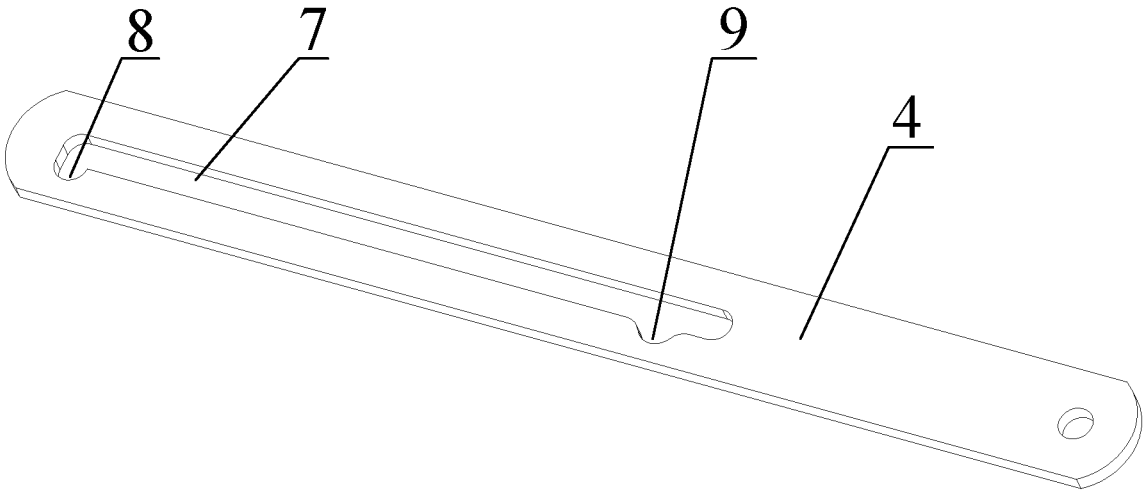
FIG. 4 is a schematic view showing the structure of a connecting plate according to the first embodiment of the present application.
Figure 5:
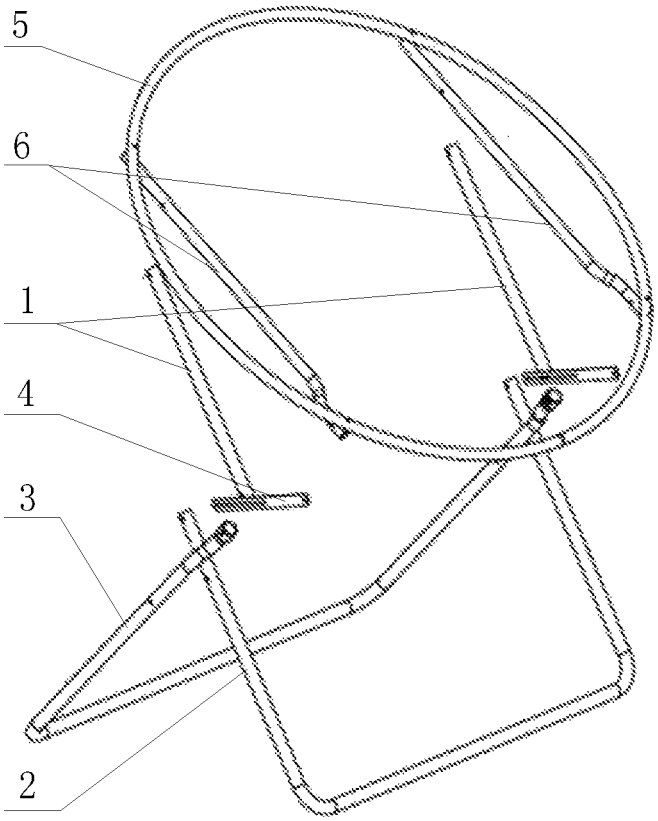
FIG. 5 is an exploded view showing the structure of the collapsible chair according to a second embodiment of the present application.
Figure 6:
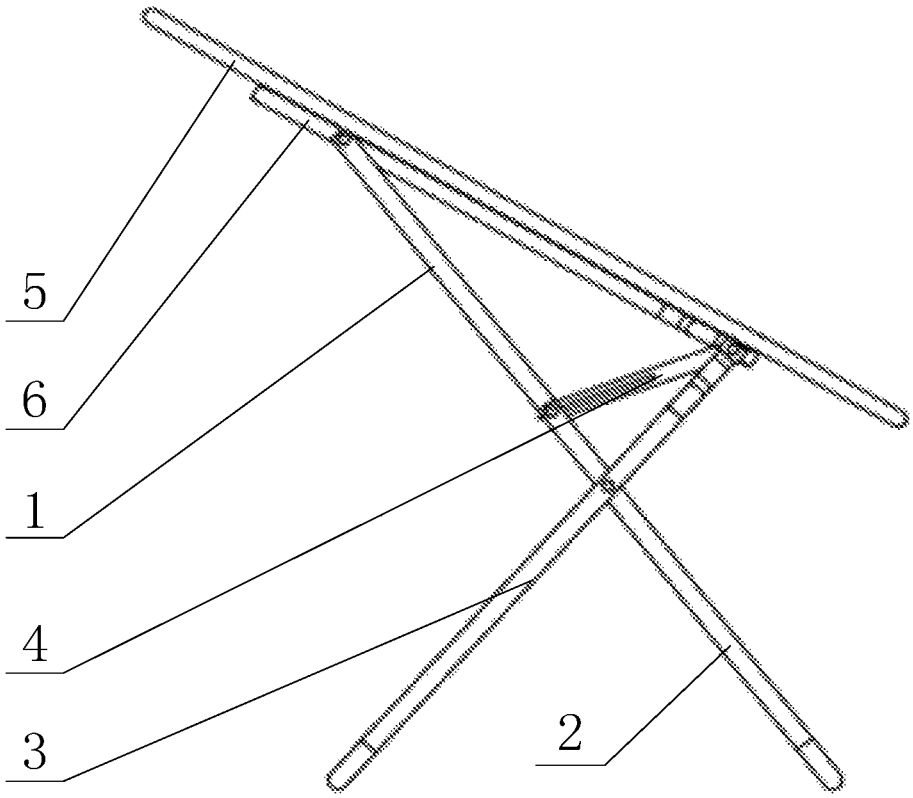
FIG. 6 is a side view showing the structure of the collapsible chair according to the second embodiment of the present application.
Figure 7:
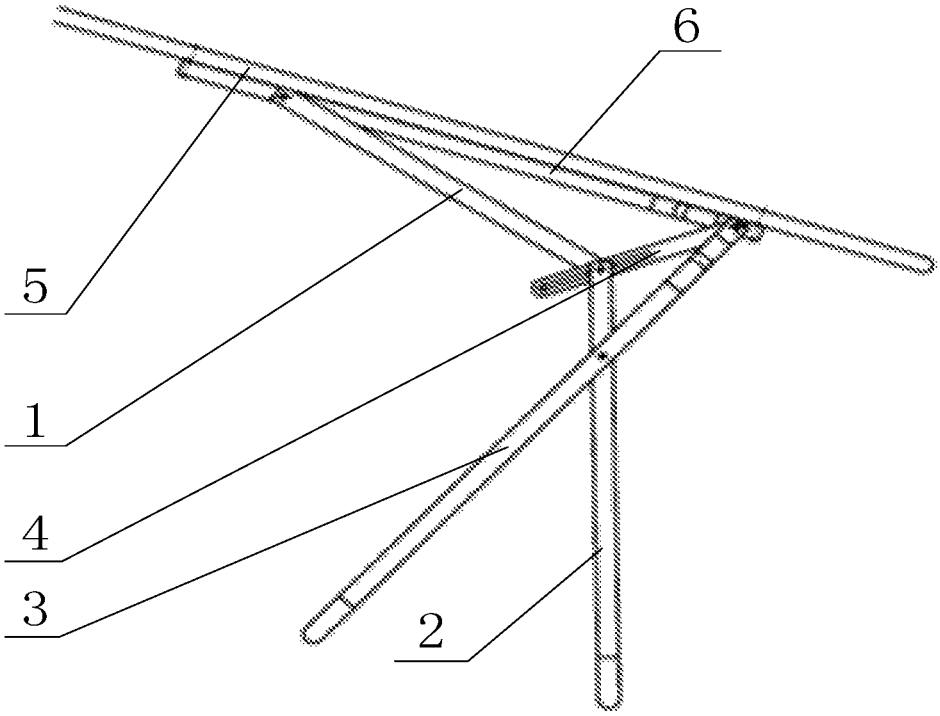
FIG. 7 is a schematic view showing the structure of the collapsible chair in a folding state according to the second embodiment of the present application.
Figure 8:
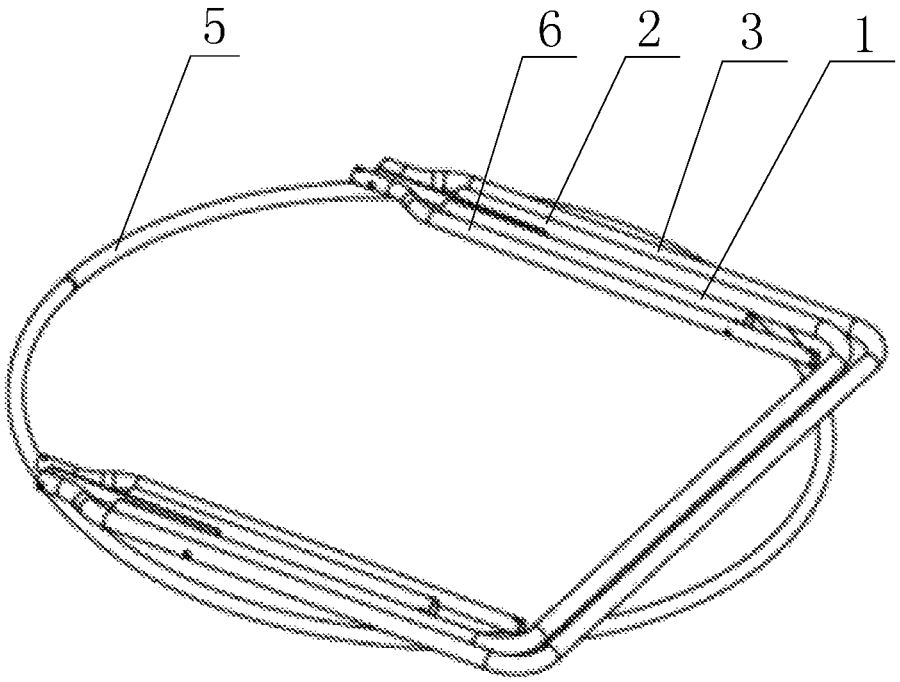
FIG. 8 is a schematic view showing the structure of the collapsible chair after being folded according to the second embodiment of the present application.

In the above FIGS. 1 to 8:

| | |
|---|---|
| first front leg tube 1, | second front leg tube 2, |
| rear leg tube 3, | connecting plate 4, |
| seat frame tube 5, | connecting rod 6, |
| slide groove 7, | first limiting groove 8, |
| second limiting groove 9, | U-shaped connecting component 10. |

DETAILED DESCRIPTION

In order to make the purpose, technical solution and advantages of the embodiments of the present application more clear, the technical solutions in the embodiments of the present application are clearly and completely described in the following with reference to the accompanying drawings in the embodiments of the present application, apparently, the described embodiments are part of the embodiments of the present application, and not all of them. All other embodiments obtained by those skilled in the art based on the embodiments of the present application without creative efforts fall within the scope of protection of the present application.

A collapsible chair includes a seat frame tube, and a support bracket having a mirror structure. The support bracket includes a first front leg tube, a second front leg tube, a rear leg tube, and a connecting plate. A top end of the first front leg tube is hinged with an upper portion of the seat frame tube, a bottom end of the first front leg tube is hinged with a top end of the second front leg tube, the top end of the rear leg tube and one end of the connecting plate are hinged with a lower portion of the seat frame tube, and a hinge portion of the first front leg tube and the second front leg tube is slidable along the connecting plate, and the second front leg tube is hinged with the rear leg tube at a position having a certain distance from the top end of the second front leg tube.

The support bracket of the mirror structure has a hypothetical mirror surface, and the mirror structure is in a mirror symmetrical state through the mirror surface. The mirror surface is used below to define "inside" and "outside". Taking the connecting plate as an example, a side of the connecting plate that faces to the mirror surface is defined as "inside", and a side of the connecting plate away from the mirror surface is defined as "outside". For other components, the definition of "inside" and "outside" is the same as that of the connecting plate, and details are not described herein again.

Specific embodiments are described by taking a collapsible moon chair as an example. The moon chair looks like a sunken semi-spherical shape, like the moon, so it is called the moon chair.

FIGS. 1 to 4 show a collapsible chair according to a first embodiment of the present application, that is, a collapsible moon chair, which includes a seat frame tube 5 and a support bracket having a mirror structure, the support bracket includes a first front leg tube 1, a second front leg tube 2, a rear leg tube 3 and a connecting plate 4. The connecting plate 4 is provided with a slide groove 7, a lower portion of one end of the slide groove 7 is provided with a first limiting groove 8 and the lower portion of another end is provided with a second limiting groove 9, a top end of the first front leg tube 1 is hinged with an upper portion of the seat frame tube 5, the bottom end of the first front leg tube 1 is hinged with the top end of the second front leg tube 2, and a pin shaft at the hinge between the first front leg tube 1 and the second front leg tube 2 is provided in the slide groove 7 in a sliding manner, the top end of the rear leg tube 3 is hinged with the lower portion of the seat frame tube 5, one end of the connecting plate 4 is hinged with the lower portion of the seat frame tube 5, and a tube body of the second front leg tube 2 is hinged with a tube body of the rear leg tube 3.

Since the first front leg tube 1 and the second front leg tube 2 are connected at the hinge position, the connection between the first front leg tube 1 and the second front leg tube 2 has a rotatable point, the rotatable point may slide in the slide groove 7 of the connecting plate 4, when the rotatable point slides to a last end of the connecting plate 4, the collapsible chair is opened, the pin shaft is stuck in the first limiting groove 8 to ensure the opening state, when the second front leg tube 2 is rotated backward, the pin shaft is moved upward which may be detached from the first limiting groove 8, the rotatable point may slide in the slide groove 7 of the connecting plate 4, and the collapsible chair is folded until the first front leg tube 1, the second front leg tube 2, the rear leg tube 3, and the connecting plate 4 are completely folded in one plane, thus the folding of the collapsible chair is achieved, at this time, the pin shaft is stuck in the second limiting groove 9 to ensure the folding state. The hinged first front leg tube 1 and second front leg tube 2 are folded inward, thus the folding is achieved. Each front leg tube is completely under a seat level after folding, and a length of the collapsible chair is shorter, and an overlap is completed in one plane, the folding thickness thereof is small and the volume after being folded is reduced.

Moreover, when the collapsible chair needs to be folded, only stepping on the rear leg tube 3 by a foot and lifting the seat frame tube 5 with one hand, the collapsible chair is slowly folded, which is very convenient to use.

The collapsible chair according to the embodiment of the present application has simple operations of opening and closing; compared with the conventional ordinary collapsible chair, the folding package has a smaller volume, a simpler structure, and an addition of a limit locking function.

The slide groove 7 is a through hole, the first front leg tube 1 and the second front leg tube 2 are hinged by the pin shaft, and the pin shaft is arranged within the slide groove 7, and the structure is simple and convenient to use, and the end portion of the pin shaft is provided with a limiting plate, and the limiting plate is stuck on a side wall of the sliding groove 7, so that the pin shaft does not detach from the sliding groove 7 when sliding in the sliding groove 7.

A U-shaped connecting component 10 may be used for the hinge between the top end of the first front leg tube 1 and the upper portion of the seat frame tube 5. The U-shaped connecting component 10 may be used for the hinge between the top end of the rear leg tube 3 and the lower portion of the seat frame tube 5.

In order to further optimize the above solution, the first front leg tube 1 and the second front leg tube 2 are both located inside the connecting plate 4, and are located in the range of the frame tube 5 after the collapsible chair is folded, and the folding volume is smaller.

In order to further optimize the above solution, the top end of the rear leg tube 3 and the connecting plate 4 are hinged with the seat frame tube 5 at a same position, thereby further reducing the number of components and reducing the folding volume.

The second front leg tube 2 is provided inside the rear leg tube 3, since the rear leg tube 3 is directly hinged with the seat frame tube 5, the rear leg tube 3 is a straight tube, and the rear leg tube 3 can be regarded as an edge position of the seat frame tube 5, then the second front leg tube 2 is provided closer to the mirror surface than the rear leg tube 3, which ensures the second front leg tube 2 and the rear leg tube 3 to be located within the range of the seat frame tube 5 after the collapsible chair is folded, and the folding volume is smaller.

FIGS. 5 to 8 show a collapsible chair according to a second embodiment of the present application, that is, a collapsible moon chair, which includes a seat frame tube 5 and a support bracket having a mirror structure, and a left side and a right side of the seat frame tube 5 are symmetrically disposed with a connecting rod 6, respectively. The support bracket includes a first front leg tube 1, a second front leg tube 2, a rear leg tube 3 and a connecting plate 4. The connecting plate 4 is provided with a slide groove, a top end of the first front leg tube 1 is hinged with an upper portion of the connecting rod 6, the bottom end of the first front leg tube 1 is hinged with the top end of the second front leg tube 2, and the hinge between the first front leg tube 1 and the second front leg tube 2 is slidable in the slide groove, the top end of the rear leg tube 3 and the end portion, away from the slide groove, of the connecting plate 4 are hinged with the lower portion of the connecting rod 6, and a rod body of the second front leg tube is hinged with the rod body of the rear leg tube 3.

Since the first front leg tube 1 and the second front leg tube 2 are connected at the hinge position, the connection between the two has a rotatable point, the rotatable point may slide in the slide groove of the connecting plate 4, when the rotatable point slides to the last end of the connecting plate 4, the collapsible chair is opened, when the second front leg tube 2 is rotated backward, the rotatable point may slide in the slide groove of the connecting plate 4, and the collapsible chair is folded until the first front leg tube 1, the second front leg tube 2, the rear leg tube 3, and the connecting plate 4 are completely folded in one plane, so that the folding of the collapsible chair is achieved. In the collapsible chair, a long front leg tube is cut into the first front leg tube 1 and the second front leg tube 2, which are folded inward to achieve folding, each front leg tube is completely under a seat level after folding, and the length is shorter, and an overlap is completed in one plane, the folding thickness is small and the volume after folding is reduced.

The slide groove is a through hole, the first front leg tube 1 and the second front leg tube 2 are hinged by a pin shaft, and the pin shaft is arranged within the slide groove, specifically, the first front leg tube 1 is located inside the connecting plate 4, the second front leg tube 2 is located outside the connecting plate 4, or, the first front leg tube 1 is located outside the connecting plate 4 and the second front leg tube 2 is located inside the connecting plate 4.

The top end of the rear leg tube 3 and the connecting plate 4 are hinged with the connecting rod 6 at the same position. The connecting rod 6 is provided with a bending portion, and the rear leg tube is closer to the mirror surface than the second front leg tube 2.

Compared with the previous embodiment, the collapsible chair according to the embodiment of the present application mainly adds a connecting rod, which can make the collapsible chair more stable, moreover, if the connection of the connecting rod is damaged, the connecting rod can be replaced separately and the seat frame tube does not need to be replaced. The collapsible chair of the embodiment has the advantages of simple operation of opening and closing, and has the advantages of smaller packaging volume and simpler structure than conventional collapsible chairs.

The above description of the disclosed embodiments enables those skilled in the art to make or use the present application. Various modifications to these embodiments are obvious to those skilled in the art, and the general principles defined herein may be implemented in other embodiments without departing from the spirit or scope of the present application. Therefore, the present application is not limited to the embodiments shown herein, but is to be accorded the broadest scope of the principles and novel features disclosed herein.

The invention claimed is:

1. A collapsible chair, comprising:

a ring-shaped seat frame tube, and a support bracket having a mirror structure, wherein the support bracket comprises two rod-shaped first front leg tubes, an U-shaped second front leg tube, an U-shaped rear leg tube, and two connecting plates, a distal end of each first front leg tube is pivotably connected to the seat frame tube, a proximal end of each first front leg tube is pivotably connected to a corresponding end of the U-shaped second front leg tube, one end of the U-shaped rear leg tube and one end of a corresponding connecting plate are pivotably connected together and to the seat frame tube at an intermediate position of the seat frame tube, and a pivoted shaft of the first front leg tube and the second front leg tube is slidable along the connecting plate, and the second front leg tube is pivotably connected to the rear leg tube at a position having a certain distance from the end of the second front leg tube, when the collapsible chair is in an unfolded use position, the first front leg tubes and the U-shaped second front leg tube defining a plane.

2. The collapsible chair according to claim 1, wherein the one end of the rear leg tube and the connecting plate are pivotably connected to the seat frame tube at the second position of the seat frame tube.

3. The collapsible chair according to claim 1, wherein the first front leg tube and the second front leg tube are located inside the connecting plate.

4. The collapsible chair according to claim 1, wherein the first front leg tube is located inside the connecting plate and the second front leg tube is located outside the connecting plate, or, the first front leg tube is located outside the connecting plate and the second front leg tube is located inside the connecting plate.

5. The collapsible chair according to claim 1, wherein the second front leg tube is closer to a mirror surface of the mirror structure than the rear leg tube.

6. The collapsible chair according to claim 1, wherein a left side and a right side of the seat frame tube are symmetrically disposed with a connecting rod, respectively, and the one end of the first front leg tube is pivotably connected to the seat frame tube via an upper portion of the connecting rod, the one end of the rear leg tube and one end of the connecting plate are pivotably connected to the seat frame tube via a lower portion of the connecting rod.

7. The collapsible chair according to claim 6, wherein the one end of the rear leg tube and the connecting plate are pivotably connected to the connecting rod at the intermediate position.

8. The collapsible chair according to claim 6, wherein the connecting rod is provided with a bending portion.

9. The collapsible chair according to claim 1, wherein the connecting plate is provided with a slide groove, a hinge between the other end of the first front leg tube and the one end of the second front leg tube is slidable in the slide groove.

10. The collapsible chair according to claim 9, wherein the slide groove is a through hole, the first front leg tube and the second front leg tube are pivotably connected by a pin shaft, and the pin shaft is arranged within the slide groove.

11. The collapsible chair according to claim 9, wherein the lower portion of one end of the slide groove is provided with a first limiting groove and the lower portion of another end of the slide groove is provided with a second limiting groove.

12. The collapsible chair according to claim 10, wherein an end portion of the pin shaft is provided with a limiting plate and the limiting plate is blocked by a side wall of the connecting plate adjacent to the slide groove.

* * * * *